US009739534B2

(12) United States Patent
Christ

(10) Patent No.: US 9,739,534 B2
(45) Date of Patent: Aug. 22, 2017

(54) LOADING AND/OR UNLOADING DEVICE FOR A FREEZE DRYING SYSTEM

(75) Inventor: Martin Christ, Osterode (DE)

(73) Assignee: Martin Christ Gefriertrocknungsanlagen GmbH, Osterode (DE)

( * ) Notice: Subject to any disclaimer, the term of this patent is extended or adjusted under 35 U.S.C. 154(b) by 1058 days.

(21) Appl. No.: 13/699,005

(22) PCT Filed: Sep. 22, 2011

(86) PCT No.: PCT/EP2011/004736
§ 371 (c)(1),
(2), (4) Date: Nov. 20, 2012

(87) PCT Pub. No.: WO2012/048789
PCT Pub. Date: Apr. 19, 2012

(65) Prior Publication Data

US 2013/0185952 A1 Jul. 25, 2013

(30) Foreign Application Priority Data

Oct. 11, 2010 (DE) ..... 10 2010 047 744

(51) Int. Cl.
*F26B 13/30* (2006.01)
*F26B 25/00* (2006.01)
*F26B 5/06* (2006.01)

(52) U.S. Cl.
CPC ..... *F26B 25/001* (2013.01); *F26B 5/06* (2013.01); *F26B 25/003* (2013.01)

(58) Field of Classification Search
CPC ..... F26B 25/001; F26B 25/003; F26B 5/06; B65G 54/02; B65G 47/088; F16C 29/00; F16C 29/10; F16C 32/0472; F16C 32/044; H01L 21/67706; H01L 21/67709; B30B 1/103
USPC ..... 198/434; 34/92, 218; 414/331.18, 347
See application file for complete search history.

(56) References Cited

U.S. PATENT DOCUMENTS 4,017,001 A 4/1977 Barthalon et al.
4,624,617 A * 11/1986 Belna ..... B65G 54/02 104/282
4,815,921 A * 3/1989 Yamamoto ..... F26B 25/001 414/280

(Continued)

FOREIGN PATENT DOCUMENTS

DE 2930534 A1 2/1981
DE EP 0782686 B1 * 3/1999 ..... B65G 47/088

(Continued)

*Primary Examiner* — Kenneth Rinehart
*Assistant Examiner* — Wes Anderson, Jr.
(74) *Attorney, Agent, or Firm* — Fox Rothschild LLP

(57) ABSTRACT

A device for loading and unloading the utility surface (3') of a drying chamber (2) of a freeze drying system. The device includes a carriage (8) which forms a movable guiding edge for the drying vessels (5), and is moveable on guides (7) disposed on both sides of the utility surface (3) and which extend in parallel with the movement direction and form fixed guiding edges for the drying vessels (5). At least one linear motor is provided to produce a drive for the carriage. All of the components of the device can be located inside the drying chamber (1), and the device of the present invention is suitable for upgrading existing freeze drying systems.

19 Claims, 8 Drawing Sheets

(56) References Cited

U.S. PATENT DOCUMENTS

| | | | | |
|---|---|---|---|---|
| 5,069,440 | A | 12/1991 | Lazzarotti et al. | |
| 5,261,774 | A | 11/1993 | Le Floc'h et al. | |
| 6,206,173 | B1 * | 3/2001 | Gallet | B65G 47/088 198/434 |
| 6,523,277 | B1 * | 2/2003 | Claggett | F26B 15/24 34/104 |
| 7,210,889 | B2 | 5/2007 | McFarland | |
| 7,343,696 | B2 * | 3/2008 | Covert | F26B 5/06 34/92 |
| 7,695,230 | B2 | 4/2010 | Selch | |
| 7,762,383 | B2 | 7/2010 | Damen | |
| 2012/0186947 | A1 | 7/2012 | Christ | |

FOREIGN PATENT DOCUMENTS

| | | | |
|---|---|---|---|
| DE | 10307571 | A1 | 9/2004 |
| DE | 602004003692 | T2 | 10/2007 |
| DE | 102007046172 | A1 | 4/2009 |
| WO | 2005/121671 | A1 | 12/2005 |
| WO | 2011/045008 | A1 | 4/2011 |

* cited by examiner

LOADING AND/OR UNLOADING DEVICE FOR A FREEZE DRYING SYSTEM

FIELD OF THE INVENTION

The invention relates to a loading and/or unloading device for a freeze drying system for pushing drying vessels, which contain a product to be dried and stand on one of the plurality of utility surfaces of the drying chamber of the freeze drying system, in a movement direction for the purpose of unloading or loading the utility surface through at least one opening in the wall of the drying chamber, having a carriage which forms a guiding edge movable in the movement direction, is intended to exert a feeding action upon the drying vessels and is supported so as to be movable on guides which are disposed inside the drying chamber on both sides at a spaced interval from the utility surface to be loaded or unloaded, are in parallel with one another and with the movement direction and form guiding edges.

BACKGROUND OF THE INVENTION

A device of this type is already known from German patent application 10 2009 049 142.2-16 by the Applicant dated Oct. 12, 2009.

The method of freeze drying is used in the case of thermally sensitive products, such as e.g. pharmaceutical and biochemical products, foodstuffs etc., wherein the product to be dried is initially frozen, crystallized ice is sublimated from the product under vacuum and is precipitated on condensers once again as ice. For this purpose, the pressure, temperature and further parameters of the drying process are controlled and monitored according to a product-specific sublimation pressure curve, in order to achieve reproducible drying results. The energy required for the sublimation is generally supplied by heating.

In many cases, freeze drying systems are designed for intermittent operation and consist predominantly of a drying chamber and a condenser chamber which is connected thereto via a closable opening, wherein the product to be dried is received in a plurality of drying vessels, bottles, ampoules or even trays which are placed on a utility surface inside the drying chamber in order to effect drying. In the drying chamber, a plurality of such utility surfaces are disposed in a frame at a spaced interval one on top of the other so as to be vertically displaceable. Since, in the case of a drying procedure, a large number of drying vessels—each containing a specific quantity of product to be dried—have to be introduced into the drying chamber depending upon the size of the freeze drying system and then have to be removed upon completion of the drying procedure, it is conventional to use automated devices both for loading and unloading the drying vessels, wherein in the case of the systems today it is necessary to establish at the time of ordering whether loading and/or unloading are to be performed manually or by means of corresponding automated devices. Nowadays, it is impossible or very expensive to upgrade a freeze drying plant, which is to be loaded and/or unloaded manually, to an integrated automated process.

In view of the temperature sensitivity of the product to be dried, but in particular owing to the need to produce aseptically perfect conditions in all system components which come into contact with the product to be dried, for the design of a loading and unloading device particular attention must be given to how its configuration and mode of operation appear from a point of view of aseptic production.

The object of the invention is to configure a device of the type presented in the introduction alternatively with respect to the subject matter of the associated main application 10 2009 049 142.2-16 such that in addition to a mechanically simple structure which can also be retrofitted, without significant outlay, on chambers prepared in accordance with the invention, attention is paid in particular to matters of asepsis which means that maintenance and cleaning work can be performed in a convenient manner.

The essential components of the device, namely a carriage and two guides which are independent of the utility surface and on which the carriage is supported, are located inside the drying chamber, wherein the guides form fixed guiding edges on both sides of a movement direction in which loading or unloading takes place, and wherein the carriage forms a movable guiding edge which extends transversely with respect to this movement direction. Depending upon a loading or unloading procedure, the carriage is always movable to a corresponding side of the drying vessels, in order to exert a feeding action. It is particularly advantageous that the guides exert a guiding function upon the drying vessels to be moved and also serve to support the carriage. These components which are preferably encapsulated and formed with smooth walls are easy to clean and should be accessible in particular for steam pressure sterilization but also for other sterilization methods. In each case, the carriage is connected to a drive.

The drive which is allocated to the carriage(s) is formed as a linear motor whose primary part is structurally integrated into the guide of the carriage and whose secondary part which is formed by a sequence of permanent magnets is connected to the carriage. This type of drive is adapted most effectively to the operating conditions of a freeze drying system described in the introduction, as it operates without any friction, maintenance and disruption even under extreme conditions and produces virtually no abrasion. Preferably, two secondary parts are provided, of which in each case one is disposed on the lateral ends of the carriage, wherein the respective primary parts are accommodated in both guides.

The two components, the primary part and secondary part, can also be produced as components which have completely smooth walls on the outer side and whose electromagnetic functional elements are disposed in a hermetically encapsulated manner, so as to permit particularly easy cleaning, in particular sterilization.

The connection, in terms of control engineering, of the primary part(s) of the linear drive, which is allocated to the carriage, by means of an external control located outside the drying chamber can be effected in the simplest case by means of a group of lines which is connected to the guide and is guided via a vacuum-sealed wall passage into the outer space. However, in order to save on the number of lines used, with regard to contamination it is also possible in this respect to provide multiple usage of a line in the sense that it is used for energy transmission and data transmission simultaneously.

Both the carriage and the guides extend in a plane slightly above the plane in which the utility surface is located in the loading or unloading position. In each case, the carriage and the guides form guiding edges which extend perpendicularly with respect to the utility surface and form large smooth bearing surfaces for the drying vessels.

In at least one embodiment, the guides do not form part of the utility surface located in the unloading or loading position and their position can be adjusted relative to one another, i.e. transversely with respect to the said movement direction. Furthermore, they can either be completely displaced in their longitudinal direction which extends in parallel with the said movement direction, or the guides are each formed in a segmented manner, wherein at least individual segments are formed so as to be displaceable. The reason for the displaceability is inter alia to be able to produce a movement of the carriage beyond a loading or unloading opening, so that during an unloading procedure the carriage effects a displacement of the drying vessels from the drying chamber and onto an unloading table available at this location, or during a loading procedure the carriage is movable to a position behind the drying vessels, so that a feeding function can be executed in the direction towards the drying chamber. The reason for the segmentation is also to create gaps in the region of the guides external to a loading or unloading procedure, so that during a drying procedure there are no collisions with parts of the frame which accommodates the utility surfaces in the drying chamber.

In accordance with the features of at least one embodiment, the guides can also be arranged to support two carriages. In this case, unloading and loading can be performed provided that a feeding function is exerted via the one carriage located behind the drying vessels as seen in the respective feeding direction, whereas a counter holding function is exerted via the other carriage. In this manner, the standing stability of the drying vessels is improved whilst cycle times are short.

In accordance with the features of other embodiments, the loading and unloading device comprises a bridge part which is disposed outside the drying chamber, can be moved vertically and optionally horizontally and forms the link to conveying devices located downstream. This bridge part is intended to cooperate with the utility surface located in the unloading position and the guides or segments thereof are displaceable in the longitudinal direction provided that a feeding action as far as to the bridge part can be effected by the carriage.

In accordance with the features of another embodiment, the bridge part can also be used for loading purposes.

In other embodiments, the bridge part is intended for loading purposes and corresponds substantially to the bridge part intended for unloading purposes, i.e., is disposed so as to be movable vertically and optionally horizontally and in a loading position extends in a common plane with the utility surface to be loaded, directly adjoining same. It is essential that even in this case the guides or segments thereof are movable provided that the carriage is movable beforehand to a position behind the drying vessels standing on the bridge part such that a feeding function can be exerted upon them in the direction towards the utility surface. The guides or even segments thereof can be continued by means of segments disposed outside the drying chamber, in order to provide corresponding displaceability of the carriages.

In at least one embodiment, features of the invention serve to improve the displaceability of the drying vessels, particularly in large utility surfaces which accommodate a large number of drying vessels. In particular, it is possible in this manner to make allowance for the situation that the drying vessels are not positioned in an ordered fashion one behind the other but rather with gaps left therebetween, which during a displacement otherwise involves the risk of the drying vessels becoming wedged and toppling over.

In at least one embodiment, features of the invention are directed to an improvement in the accuracy of the positioning of a utility surface e.g. in the loading or unloading position. In general, exact positioning can only be achieved to limited extent merely by using the said plate frame which is to be actuated hydraulically.

A further advantage which arises from the use of the system of supports, in particular the provision of a height position—independent of the frame—of a utility surface resides in the fact that e.g. in the unloading position the vertical distance between the utility surfaces can be adapted to the height of the drying vessels. Sealing the drying vessels in a vacuum by means of rubber stoppers is known, by means of which, after the stoppers have been inserted, they can adhere to the utility surfaces which are located above them in each case, a situation which at the very least hampers ordered extraction from the drying chamber. In contrast, in accordance with the invention a small spaced interval can be adjusted between the rubber stoppers and the utility surface located thereabove and thus extraction from the drying chamber which is not disrupted by adherence of the rubber stoppers.

In further embodiments of the device in accordance with the invention, the second carriage can assume a rest position or can effect a counter holding function on the drying vessels.

It is apparent from the embodiments above that the loading and/or unloading device which is composed of a small number of components which can be handled simply in aseptic terms is also particularly suitable for the retrofitting of existing freeze drying systems in stages. This is aided and abetted by the fact that the components thereof do not come into contact with the utility surfaces.

In particular, it can be provided that the carriage together with the secondary part(s) forms a passive unit which does not have any electrical or mechanical connection to the entire system and can be removed from the guides for cleaning purposes.

BRIEF DESCRIPTION OF THE DRAWINGS

The invention will be explained in greater detail hereinafter with reference to the accompanying drawings, in which.

DETAILED DESCRIPTION

Figure 1:
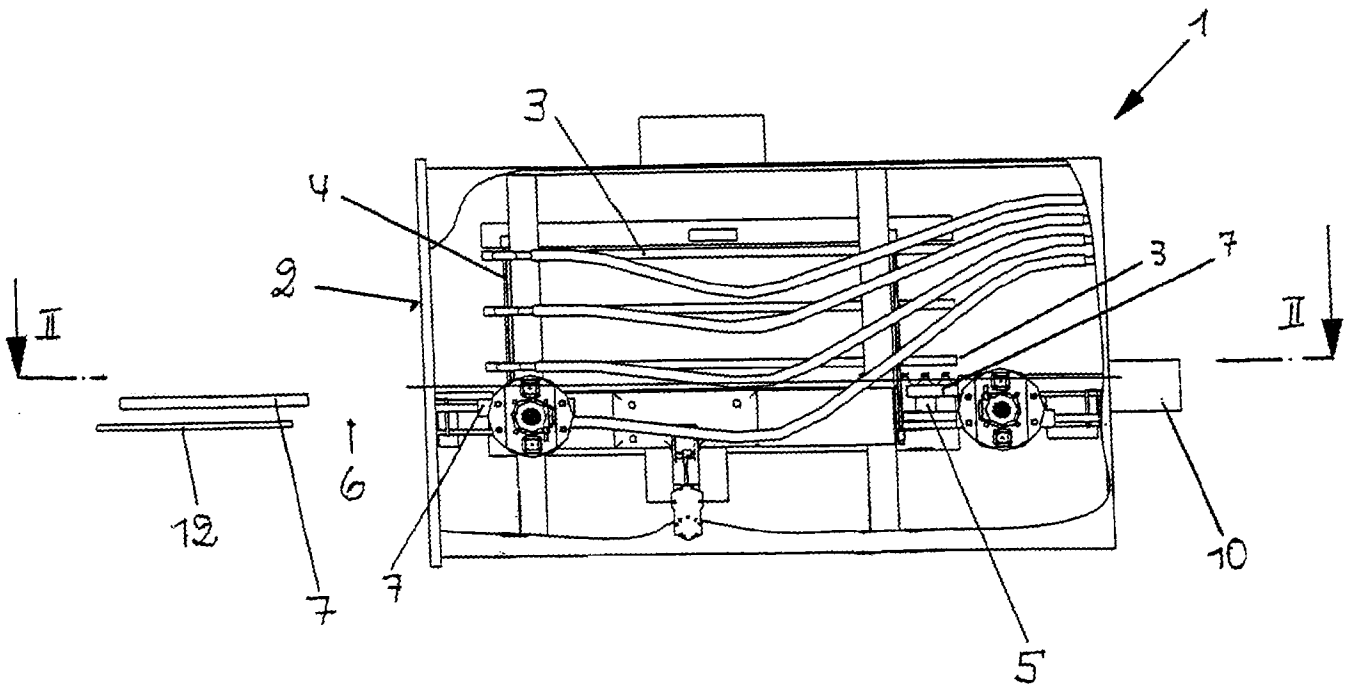
FIG. 1 shows a vertical sectional view of a drying chamber of a freeze drying system having an unloading device in accordance with the invention.

FIG. 1 illustrates a sectional view of the drying chamber 1 of a freeze drying system, in whose front side 2 there is located a closable opening, not shown in the drawings, for loading or unloading drying vessels 5. The drying chamber 1 is connected to a condenser chamber in a manner known per se, however this will not be explained in greater detail at this juncture.

Located inside the drying chamber 1 is an arrangement of utility surfaces 3 which are held in a frame 4 in a manner known per se so as to be vertically movable. These utility surfaces 3 are used for positioning drying vessels 5 which each contain a substance to be dried and which are to be removed from the drying chamber 1 upon completion of the drying procedure. The reference numeral 6 designates a height position, in this case the utility surface 3' which corresponds to the unloading position of this utility surface. It is essential that the vertical adjustability of all of the utility surfaces 3 of the frame 4 is configured such that each utility surface 3 can be moved to the height position 6 which corresponds to the unloading position.

In order to explain the structure and the mode of operation of the unloading device in accordance with the invention, reference is first made hereinafter additionally to FIG. 2, in which functional elements corresponding to those of FIG. 1 are designated accordingly.

Extending on both sides of the utility surface 3', which in accordance with the illustrated exemplified embodiment is approximately rectangular, are linear strip-like guides 7 which are composed of several mutually spaced apart segments. These segments are disposed so as to be mutually displaceable in the longitudinal direction provided that they can be moved into end-face abutment with respect to one another, in this case forming a continuous guide. On the other hand, these segments can be moved to positions mutually spaced apart at the end face so that structural elements of the frame 4 which extend in immediate proximity to the lateral boundary of the utility surface 3' are not hindered by these guides 7. These guides 7 are located at a height level in parallel with that of the utility surface 3' and slightly above it. They form lateral guiding edges for the drying vessels 5 which are to be displaced in the direction towards the front side 2 during an unloading procedure.

Furthermore, the guides 7 can be displaceable in parallel with the plane of the utility surface 3' and transversely with respect to the longitudinal direction thereof, so as provide adaptability to suit different dimensions of the drying vessels 5. During an unloading cycle, they should always lie against the lateral guides 7, so that the lateral spaced interval of the guides 7 is always arranged in accordance with an integer multiple e.g. of the diameter of the drying vessel 5 and the drying vessels are reliably prevented from toppling over, becoming jammed or wedged. The guides 7 are displaced in the longitudinal and transverse direction and in parallel with the utility surfaces by means of drives 16, 17 which are disposed outside the drying chamber and are sealed inside the drying chamber in each case in the movement direction by means of special steel bellows.

Figure 2:
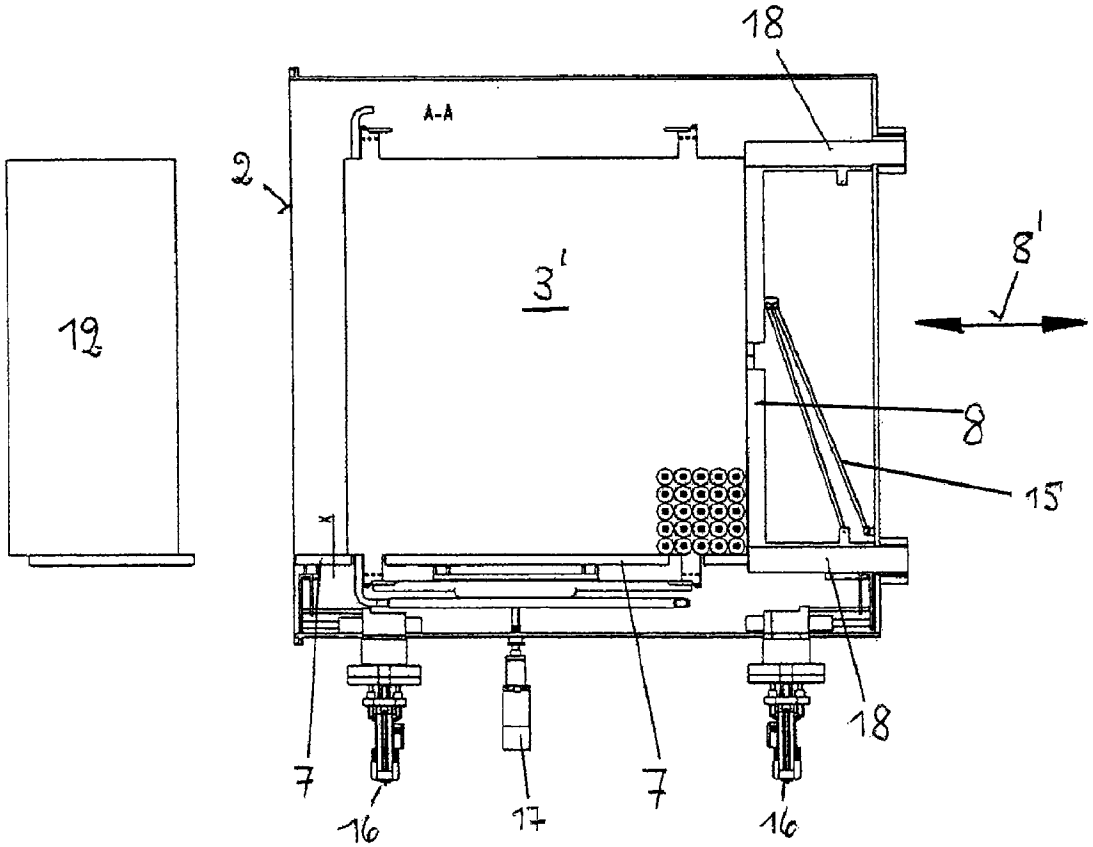
FIG. 2 shows the drying chamber of FIG. 1 in a horizontal sectional view corresponding to a sectional plane II-II.

The reference numeral 8 designates a carriage which extends in the manner of a strip perpendicularly with respect to the guide 7 and which in FIG. 2 is illustrated in its rearmost position, the parking position. The carriage 8 extends over the entire width of the utility surface 3' and during an unloading procedure forms a guiding edge which is movable in the direction towards the front side 2 and is intended to lie against the drying vessels 5 standing on the utility surface 3. Correspondingly, it is operatively connected to a drive which is to be described hereinafter. The carriage 8 is formed such that different spaced intervals of the guides 7 can be compensated for.

This drive of the carriage is formed as a linear drive and consists of two linear motors, each of which consists of a primary part, which is structurally integrated into a guide 7, and of an elongated secondary part which is designated by the reference numeral 18, supports the carriage 8 directly at the side and contains an arrangement of permanent magnets with a polarity which changes in the longitudinal direction, and which secondary part is supported so as to be able to slide on the respective guide 7. In the parking position, the secondary parts 18 can be received partially in pipe connections 10 of the wall of the drying chamber 1 which can otherwise be formed as windows. The length dimension of the segments of the guide 7 is arranged according to the accommodation of the electromagnetically active portions of the primary part which are positioned in magnetic terms perpendicularly with respect to the movement direction 8' of the carriage 8.

Energy can be supplied to the two linear motors e.g. by means of a line which is received in a flexible, vacuum-sealed special steel corrugated tube (not shown) and which is connected to the two primary parts of the two guides 7 and is connected (not shown) to an external control via a vacuum-sealed wall passage of the drying chamber 1 which receives the said tube. Since the two linear motors consist of several movable segments, they are interconnected likewise to a special steel tube (not shown). Control signals and signals describing the position of the carriage can be transmitted simultaneously via this line or even group of lines.

The Figures do not illustrate a plurality of holders which extend at a mutually spaced interval below the utility surface 3' in lateral edge regions thereof and are operatively connected to the drives 16. By means of the drives 16, the holders are movable between a first position engaging underneath the side of the utility surface 3' facing towards the holders, and a second position, in which there is no underneath-engagement. In this case, the holders can be moved together with the guides 7. Therefore, if the utility surface 3' is moved slightly downwards by means of the frame 4, wherein at the same time the holders, which lie opposite one another e.g. transversely with respect to the conveying direction 8', are located in such a position, in which there is engagement underneath one side of the utility surface 3', the respective other side of the utility surface 3', at which there is no underneath-engagement, is lowered further together with structural elements of the frame 4, so that as a result the utility surface 3' assumes an oblique position of e.g. 2° to 3° which can be expedient for cleaning purposes.

The mode of operation of the device will be explained hereinafter with reference to an unloading procedure and with supplementary reference to FIGS. 3 to 5, in which again like functional elements are designated accordingly.

Figure 3:
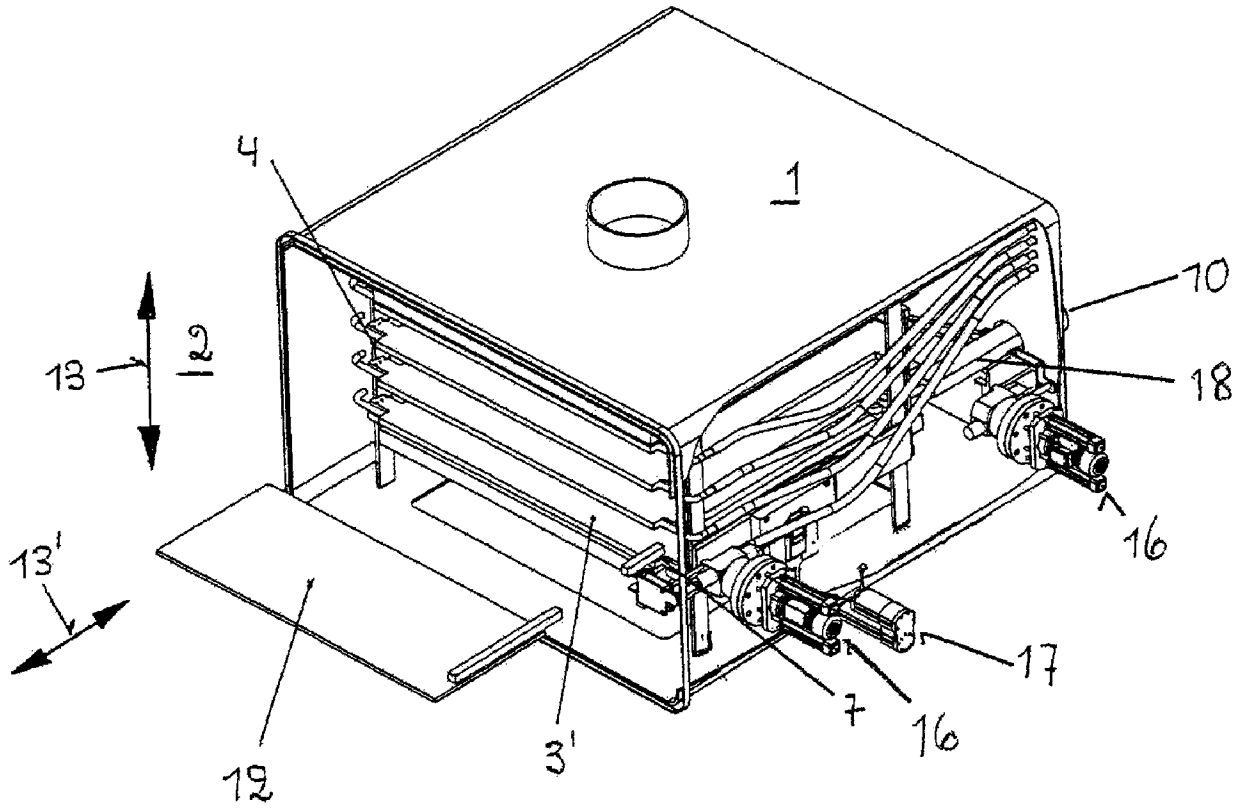
FIG. 3 shows a perspective view of the drying chamber of FIG. 1 at the beginning of an unloading procedure.

The reference numeral 12 designates a bridge part which is disposed at a small spaced interval in advance of the front side 2 of the drying chamber 1 in such a manner as to be movable vertically in the direction of the arrows 13 and/or horizontally in the direction of the arrows 13'. The bridge part 12 cooperates with further conveying devices, not illustrated in this case, for removing unloaded drying vessels 5 and in FIG. 3 is located in its rest position. The carriage 8 is located in its parking position or, with regard to the front side 2, in its rearmost position. For reasons of simplicity in the drawings, a closable opening provided in the front-side wall of the drying chamber 1 has not been illustrated.

Figure 4:
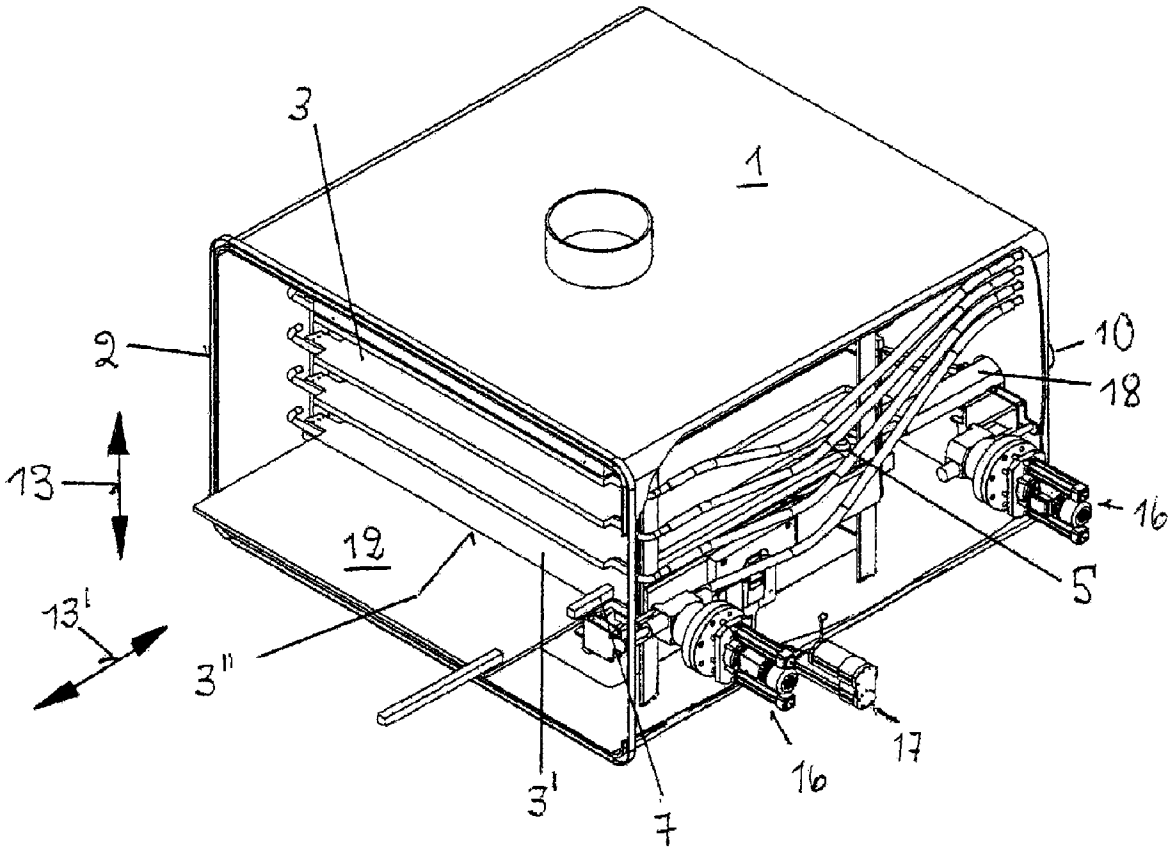
FIGS. 4, 5 show perspective views in each case of consecutive phases of the unloading device at the beginning of an unloading procedure.

In the illustration of FIG. 4, the bridge part 12 has been moved to such a position, in which the utility surface 3' is located in its unloading position, wherein the bridge part 12 lies directly against the facing boundary 3" of the positioning plate 3' which in general, i.e. when the utility surfaces 3 move vertically in the direction of the arrows 13, requires a slight horizontal displacement in the direction of the arrows 13' towards the utility surface 3'.

Figure 5:
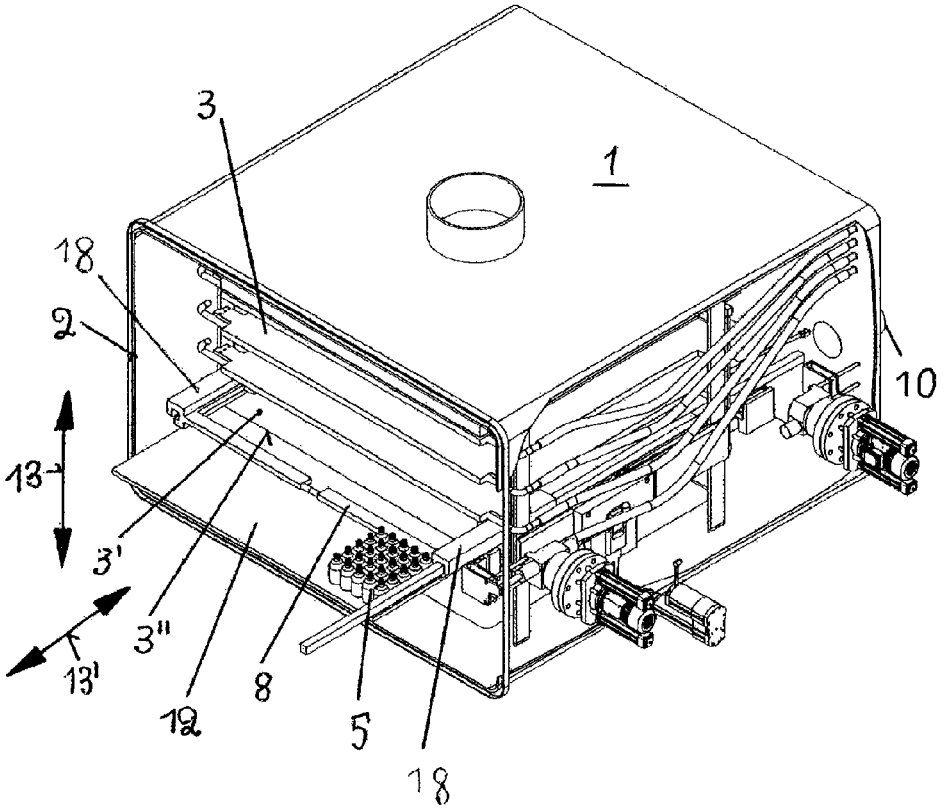

The carriage 8 is then moved in the direction towards the front side 2 by the actuation of the two linear motors, so that finally, as shown in FIG. 5, the drying vessels 5 in the utility surface 3' can be displaced beyond their front-side boundary 3" onto the bridge part 12.

The bridge part 12 is then returned to its rest position shown in FIG. 3.

An essential prerequisite for the mode of operation described above is that the guides 7 on both sides are dimensioned such that the carriage 8, as shown in FIG. 5, can be moved to a position on the bridge part 12. This can be achieved by means of a formation of the guide 7, which can be displaced in this direction, or at least by segments of the guide 7. This can also be achieved by means of an embodiment of at least segments of the guide 7 which can be telescoped in this direction.

As an alternative to this, the bridge part 12 can also be equipped with guides which supplement the effect of the guides 7 and can form part of the guided conveying devices.

As can be seen in particular in FIG. 5, the secondary part 18 of each one of the two linear motors consists of a hollow structure which engages on the outer side around the correspondingly formed guide 7 and in this way imparts a guiding function. Incorporated into this hollow structure are the permanent magnets of the secondary part which lie directly opposite the magnetically active parts of the primary part of the guide 7, and moreover such that a feeding function is produced.

The drives 16 and 17 are also intended inter alia to cause the guides 7 to effect a vibrating motion when drying vessels 5 are being inserted or removed. This measure serves to improve the displaceability of the drying vessels, in particular on large utility surfaces, in that the standing stability in the utility surface is increased during a displacement procedure.

The said holders which are each allocated to edge regions of the utility surface 3' and are connected to the drives 16 can all be moved to a position engaging underneath the utility surface 3', so that the utility surface 3' is held at a defined height. These movements of the holders can thus be effected with the guides 7. This is particularly advantageous, since precise adjustment of the vertical spaced interval between this utility surface, which is to be unloaded, and the utility surface located directly above it is permitted in this manner. In this way, it is easier to take into account different sizes of the standing drying vessels.

As soon as the drying vessels 5 have been completely removed from the utility surface 3' via the unloading table 12, another utility surface 3 loaded with drying vessels 5 which are to be unloaded can be displaced to the unloading position, whereupon the procedure described above is repeated.

The essential components of this type of unloading device, in particular the carriage 8, can be removed in the simplest manner from the drying chamber 1 for cleaning and/or sterilization purposes, optionally after disconnection from the electrical supply, and can then be inserted back into the drying chamber.

These components are also accommodated completely inside the drying chamber 1 and moreover such that—apart from an unloading procedure—there is no engagement into the space above and/or below the utility surfaces 3.

The utility surfaces 3 do not require any lateral guide strips which are fixedly connected thereto. The reason for this is that the execution of a lateral guiding effect is only required during an unloading procedure or even a loading procedure. However, this is achieved by the two lateral guides 7 which at the same time support the carriage 8 via the secondary parts 18. This means that completely smooth utility surfaces 3 which can be handled in a convenient manner from a point of view of asepsis can be used.

What has been described above is the concept of an unloading device consisting of carriage 8 which is movable in parallel with the lateral boundaries of a utility surface 3' located in the unloading position and which is supported on lateral guides 7 which at the same time exert a guiding function upon the drying vessels 5 when they are transferred to a bridge part 12.

It is also possible to perform a loading procedure in a substantially completely comparable manner, i.e. by using these components. In this case, different concepts are possible for moving a group of drying vessels standing on a bridge part into the effective region of a carriage which pushes this group and is supported on lateral guides, which guides exert a lateral guiding function upon the group at the same time.

In particular, in order to stabilize the standing position of the drying vessels, the drying vessels can be disposed between two carriages supported on the lateral guides as they are transferred onto the positioning plate of the drying chamber, wherein the carriage which is first in the feeding direction exerts a counter holding function. Conversely, this type of counter holding function can also be produced by a second carriage during an unloading procedure, so that an automated loading and unloading operation of the freeze drying system can be performed in accordance with short cycle times without the risk of the drying vessels toppling over.

An essential feature of the above-described freeze drying system is that loading and also unloading procedures can be performed via its the front side 2, so that the drying vessels are loaded and unloaded in opposite directions of displacement. However, a "pass-through operation", in which loading and unloading are effected in the same directions of displacement via mutually opposite doors in the wall of the drying chamber 1 can likewise be performed.

It is apparent that the above-described concept of an automated loading and unloading device is devised in a convenient and clear manner in terms of its mechanical mode of operation, is easy to maintain and does not interfere with any other part of the operation of a freeze drying system.

In the case of the exemplified embodiment illustrated in FIGS. 1 to 5, the drying vessels 5 are supported directly on the utility surfaces 3, 3'.

Figure 6:
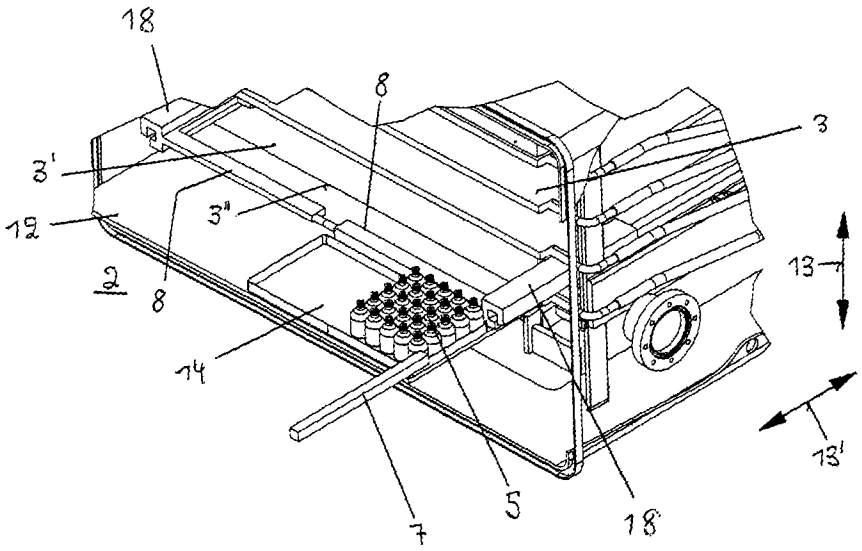
FIG. 6 shows a view of one variant of an unloading device in accordance with the invention.
Figure 7:
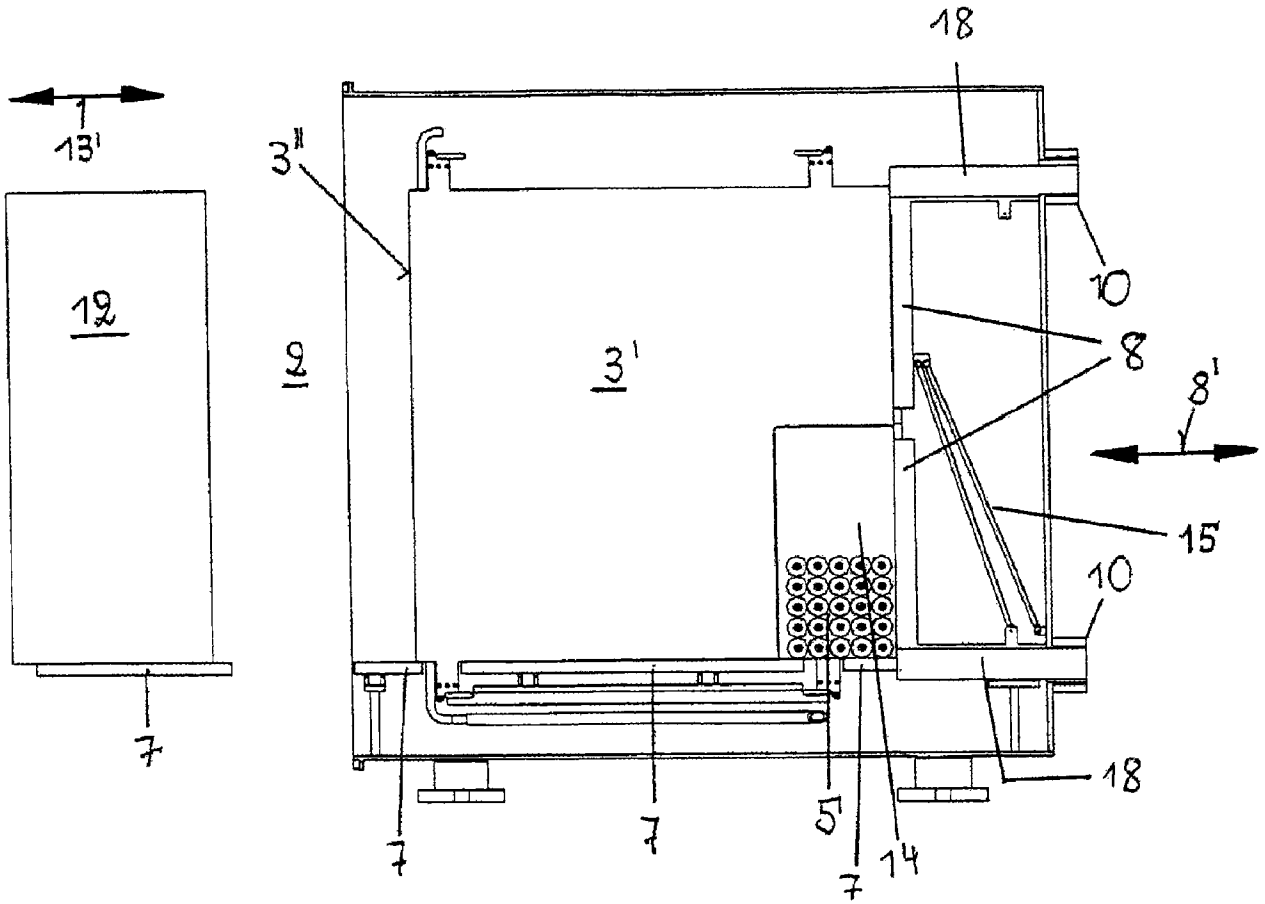
FIGS. 7, 8 show plan views in each case of consecutive phases of the unloading device of FIG. 6 during an unloading procedure.
Figure 8:
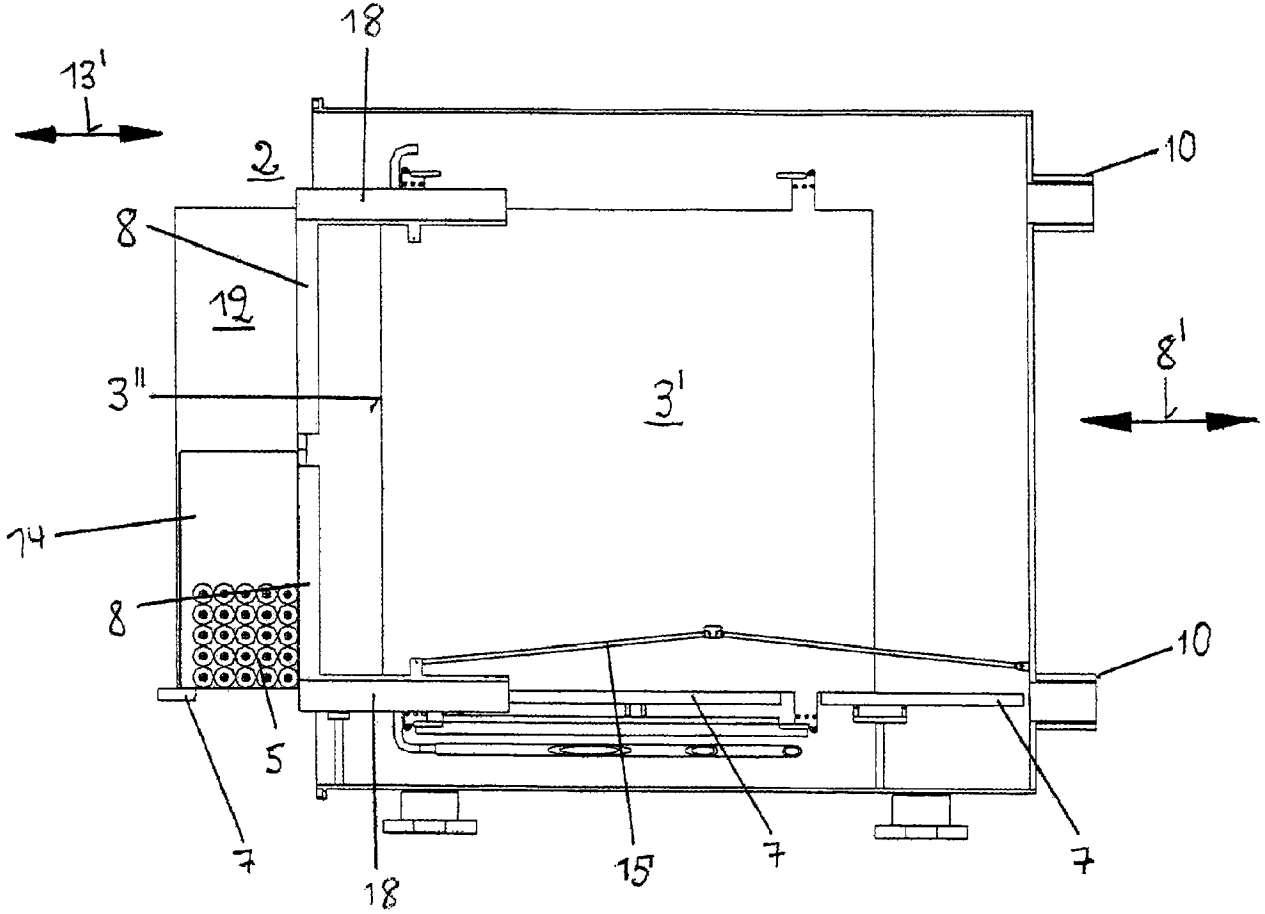

In FIGS. 6 to 8, like functional elements are again designated by like numerals, however the drives have not been illustrated, since at the very least they are not required for displacement of the guides in the longitudinal direction thereof. The drying vessels 5 stand in groups in rectangular trays 14 on the utility surfaces 3, 3', wherein these trays 14 permit uniform handling of each group of drying vessels 5 during both loading and unloading. Instead of using the trays 14, it is also possible to use e.g. rectangular frames.

This variant does not require any displacement of the segments of the guide 7, so that they are fixedly connected to the drying chamber. The carriage with the secondary parts 18 is able to travel over gaps between these segments.

FIG. 7 illustrates the beginning of an unloading procedure, wherein a tray 14, or possibly also a frame, lies with a longitudinal side against the guiding edge of the carriage 8, which tray or frame is displaced towards the front side 2 of the drying chamber by actuation of the carriage in its movement direction 8'. A bridge part 12 is moved in the direction of the arrows 13' towards the front side 2 of the drying chamber 1 as far as the position which is illustrated in FIGS. 6 and 8, is characterized by the bridge part 12 lying against the boundary 3" of the utility surface 3' and from which the tray 14 or frame can be moved from the utility surface 3 onto the bridge part 12. During the entire movement, the tray 14 is guided laterally by the guides 7 and is guided perpendicularly thereto in the direction towards the bridge part 12 by the carriage 8. In this case, the guides 7 form fixed guiding edges and the carriage 8 forms a movable guiding edge.

The variant of a loading and unloading device as illustrated in FIGS. 6 to 8 otherwise corresponds to the embodiment already described in FIGS. 1 to 5, so that in this regard a description thereof will not be repeated.

The inventive concept of this type of device is particularly suitable for permitting modular upgrading of existing devices to an automated loading and unloading procedure, in that guides which form lateral guiding edges which are independent of the utility surface can be installed consecutively and are displaceable laterally for the purpose of adapting to different diameters of the drying vessels which serve as a support for a carriage etc.

In another embodiment, the loading and unloading device can include two carriages 8 which are supported on the guides 7 and which during a loading or unloading movement are each intended to lie—as seen in the direction of displacement—against a front side so as to fulfill a counter holding function on the drying vessels 5, and to lie against the rear side so as to fulfill a feeding function on the drying vessels 5.

In yet another embodiment, the guides 7 can include two different primary parts which are disposed one above the other or one next to the other, so that a second carriage can be moved independently of the carriage 8 by means of a second secondary part which is disposed so as to be offset accordingly with respect to the first one.

In still another embodiment, the guides can consist of a plurality of segments which are disposed one behind the other, wherein individual segments can be switched to the inactive state, so that the carriage 8 can be moved on active segments and a second carriage rests on inactive segments.

LIST OF REFERENCE NUMERALS

1. drying chamber
2. front side
3. utility surface
3'. utility surface
3". boundary
4. frame
5. drying vessel
6. unloading position
7. guide
8. carriage
8'. movement direction
10. pipe connection
12. bridge part
13. movement direction
13'. movement direction
14. tray/frame
16. drive
17. drive
18. secondary part

The invention claimed is:

1. A device for pushing drying vessels, which contain a product to be dried and stand on one of a plurality of utility surfaces of a drying chamber of a freeze drying system, in a movement direction for the purpose of unloading or loading the utility surface through at least one opening in a wall of the drying chamber; the device comprising:

a carriage, which forms a guiding edge movable in the movement direction, is configured to exert a feeding action upon the drying vessels and is supported so as to be movable on guides, said guides are disposed inside the drying chamber on both sides of the utility surface to be loaded or unloaded, are in parallel with one another and with the movement direction, are independent from said utility surface so that said utility surface and said guides are moveable relative to one another, and form guiding edges; and at least one linear motor configured to produce an electromagnetic drive for moving the carriage back and forth on said guides, said linear motor having a primary part which includes electromagnetically active portions structurally integrated into at least one of the guides and a secondary part which includes an arrangement of magnets supported on the guide and connected to the carriage for slidable movement of said carriage supported on said guides.

2. The device as claimed in claim 1, wherein the guides consist of a plurality of segments which are disposed one behind the other and are disposed so as to be displaceable in their common longitudinal direction.

3. The device as claimed in claim 1, wherein the carriage can be moved inside the drying chamber on the guides to an inactive position outside the utility surface.

4. The device as claimed in claim 1, wherein the height position of the guides inside the drying chamber is fixed.

5. The device as claimed in claim 1, wherein the guides, whilst retaining their mutually parallel alignment, are disposed in such a manner as to be displaceable perpendicularly with respect to the boundaries of the utility surface, which are allocated thereto, and in parallel with the plane thereof.

6. The device as claimed in claim 1, further comprising a bridge part-which is disposed outside the drying chamber in such a manner as to be displaceable at least vertically or perpendicularly with respect to the planes of the utility surfaces.

7. The device as claimed in claim 6, wherein in an unloading position the bridge part and the utility surface to be unloaded are positioned lying one against the other in a common plane via the said opening in the wall of the drying chamber and that the guides or at least segments thereof are disposed so as to be displaceable in their longitudinal direction provided that a feeding function can be exerted as far as into the region of the bridge part-by means of the carriage.

8. The device as claimed in claim 6, wherein the bridge part can additionally be used for loading purposes.

9. The device as claimed in claim 1, further comprising a bridge part which is disposed outside the drying chamber in such a manner as to be displaceable at least vertically or perpendicularly with respect to the planes of the utility surfaces and is intended for loading purposes.

10. The device as claimed in claim 9, wherein in a loading position the bridge part and the utility surface to be loaded are positioned lying one against the other in a common plane via the said opening in the wall of the drying chamber, that the guides or at least segments thereof are disposed so as to be displaceable in their longitudinal direction provided that a feeding function can be exerted upon the drying vessels, which are standing on the bridge part, as far as onto the utility surface at least by means of a carriage.

11. The device as claimed in claim 1, further comprising means which are intended to cause the guides to effect a vibrating motion when drying vessels are being inserted or removed.

12. The device as claimed in claim 1, wherein the utility surfaces are held in a frame which permits vertical displacement of the utility surfaces inside the drying chamber, that at least one system of supports is provided which can be displaced in parallel and are intended to engage underneath a utility surface located in a defined height position, and that the frame and the system of supports are configured and disposed with the proviso that the system of supports can effect a height positioning, independent of the plate frame, of the utility surface which is engaged from underneath.

13. The device as claimed in claim 12, wherein the system of supports is allocated to the loading and/or unloading position of the utility surfaces.

14. The device as claimed in claim 1, wherein it comprises a stationary distance sensor which is not connected to the secondary part and is designed for detecting the position of the secondary part.

15. The device as claimed in claim 14, wherein the distance sensor is a laser-optic sensor which is attached outside the drying chamber to a pipe connection of the drying chamber wall which partially accommodates the secondary parts.

16. The device as claimed in claim 2, wherein the carriage can be moved inside the drying chamber on the guides to an inactive position outside the utility surface.

17. The device as claimed in claim 2, wherein the height position of the guides inside the drying chamber is fixed.

18. The device as claimed in claim 1, wherein the guides are fixedly connected to the drying chamber and each guide includes at least two segments with a gap therebetween, and wherein the secondary parts are configured to travel over the gaps between the segments.

19. A device for pushing drying vessels, which contain a product to be dried and stand on one of a plurality of utility surfaces of a drying chamber of a freeze drying system, in a movement direction for the purpose of unloading or loading the utility surface through at least one opening in a wall of the drying chamber; the device comprising:

a carriage, which forms a guiding edge movable in the movement direction, is configured to exert a feeding action upon the drying vessels and is supported so as to be movable on guides, which guides are disposed inside the drying chamber on both sides of the utility surface to be loaded or unloaded, are in parallel with one another and with the movement direction, are independent from the utility surface so that said utility surface and said guides are moveable relative to one another, and form guiding edges, and at least one linear motor forming an electromagnetic drive for moving said carriage back and forth on at least one of the guides, said linear motor having a primary part which includes electromagnetically active portions structurally integrated into at least one of the guides and a secondary part which includes an arrangement of magnets supported on the at least one guide and connected to the carriage.

* * * * *